US005441208A

United States Patent [19]

Millen et al.

[11] Patent Number: 5,441,208

[45] Date of Patent: Aug. 15, 1995

[54] TEXTILE CORE HAVING TRANSFER TAIL ENGAGEMENT

[75] Inventors: Fred S. Millen, Darlington; John F. Auten; Jack W. Segars, both of Hartsville, all of S.C.

[73] Assignee: Sonoco Products Company, Hartsville, S.C.

[21] Appl. No.: 65,114

[22] Filed: May 20, 1993

[51] Int. Cl.[6] ..... B65H 75/28

[52] U.S. Cl. ..... 242/125.1; 242/118.32

[58] Field of Search ..... 242/118.31, 118.32, 242/125.1

[56] References Cited

U.S. PATENT DOCUMENTS

| | | | |
|---|---|---|---|
| 1,634,492 | 7/1927 | Dunlap . | |
| 2,081,331 | 5/1937 | Hathaway | 242/125.1 |
| 2,163,618 | 6/1939 | Muller | 242/120 |
| 2,219,836 | 10/1940 | Dunlap | 242/122 |
| 2,273,373 | 2/1942 | Perry | 242/118.32 |
| 2,569,094 | 9/1951 | Dunlap | 242/118.32 |
| 3,015,945 | 12/1962 | Jungbecker | 68/198 |
| 3,138,345 | 6/1964 | Lüber | 242/125.1 |
| 3,141,631 | 7/1964 | Krebs | 242/118.3 |
| 3,263,942 | 8/1966 | Elwell | 242/118.32 |
| 3,284,023 | 11/1966 | Sowell | 242/125.1 |
| 3,544,034 | 12/1970 | Jurney et al. | 242/118.32 |
| 3,625,451 | 12/1971 | Anderson | 242/125.1 |
| 3,675,871 | 7/1972 | Heyden | 242/118.3 |
| 3,752,414 | 8/1973 | Urquhart | 242/118.32 |
| 3,876,165 | 4/1975 | Comer | 242/125.1 |
| 3,967,795 | 7/1976 | Shindo et al. | 242/125.1 |
| 4,057,201 | 11/1977 | Wilkinson | 242/125.1 |
| 4,390,144 | 6/1983 | Mueller | 242/118.3 |
| 4,519,557 | 5/1985 | Newmann | 242/118.32 X |
| 4,700,834 | 10/1987 | Martinez | 206/388 |
| 4,842,213 | 6/1989 | Bärtschi et al. | 242/125.1 |
| 5,211,354 | 5/1993 | Rummage | 242/125.1 |

FOREIGN PATENT DOCUMENTS 10816 of 1895 United Kingdom .

*Primary Examiner*—Daniel P. Stodola
*Assistant Examiner*—William Stryjewski
*Attorney, Agent, or Firm*—Bell, Seltzer, Park & Gibson

[57] ABSTRACT

A textile core for winding a package of yarn. The textile core includes a tubular body having opposed ends and a bodywall formed of a paperboard material. To prevent slippage of a transfer bunch or tail formed on the core during winding processes, a plurality of spaced, discreet perforations are provided on the exterior periphery of the tubular body adjacent at least one end thereof. The perforations extend substantially around the circumferential periphery of the tubular body, and extend radially into the bodywall for only a portion of the thickness thereof. A projection adjacent each perforation is also provided, extending radially outwardly from the bodywall and formed of paperboard material removed from the adjacent perforation. The projections are capable of frictionally engaging at least one yarn winding formed on the top thereof and thus prevent slippage of the transfer tail.

9 Claims, 2 Drawing Sheets

Fig. 5.
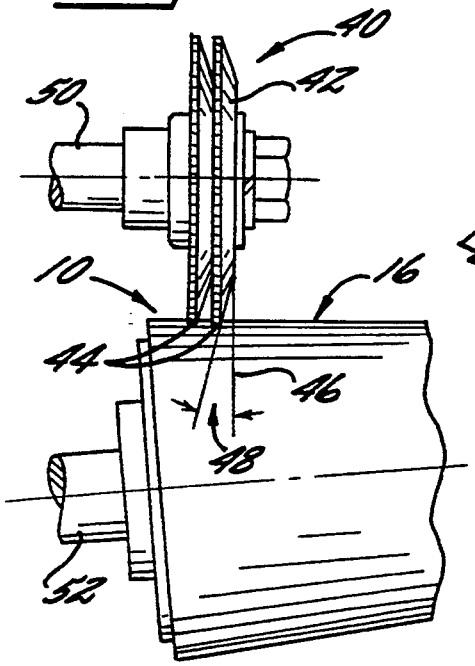
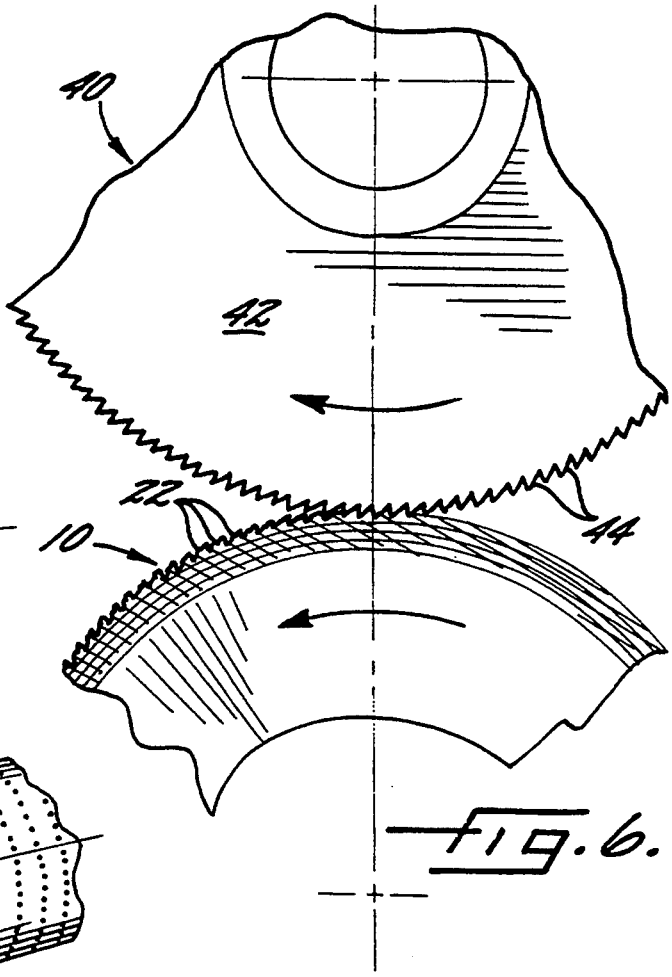
Fig. 6.
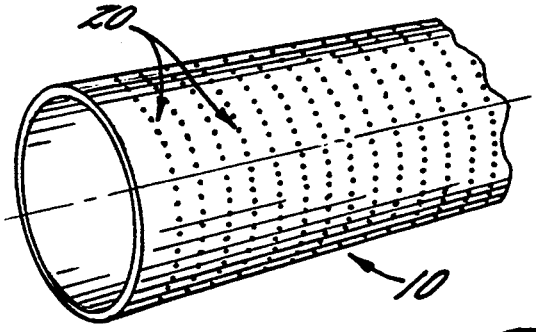
Fig. 8.
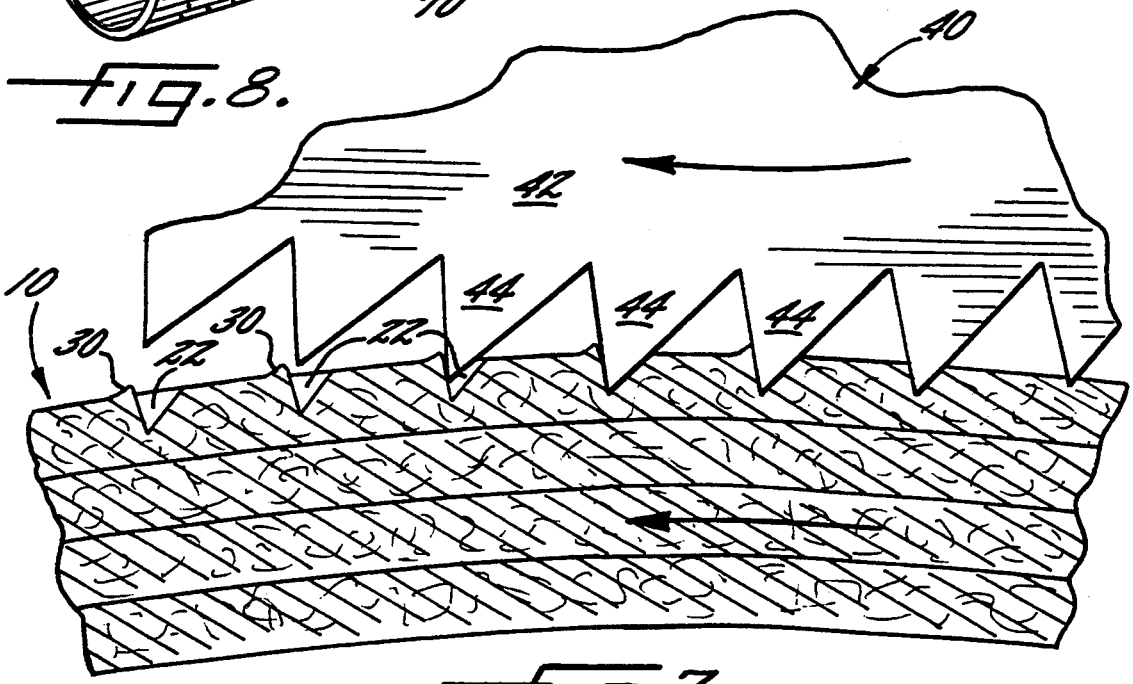
Fig. 7.

TEXTILE CORE HAVING TRANSFER TAIL ENGAGEMENT

FIELD OF THE INVENTION

The present invention is directed to an improved textile core for winding a package of yarn. More particularly, the present invention is directed to a textile core having improved yarn engagement means on the exterior peripheral surface thereof for frictionally engaging and securing a transfer tail of the yarn package during winding and after winding of the yarn onto the core.

BACKGROUND OF THE INVENTION

Textile yarn cores, i.e., yarn carriers or bobbins, are widely used in the textile industry for winding and supporting yarn packages. In the package forming process, a moving yarn line is strung up on a rapidly rotating empty core. Typically, one or more of the initial strands of yarn are introduced into a starting groove cut into the surface of one end of the core so that the yarns are thereby secured onto the tube and subsequently wound onto the core in a uniform pattern.

In building a yarn package onto a rapidly rotating core, typically a small number of initial yarn windings are provided at one end of the core spaced from the main yarn package. This initial yarn grouping is referred to in the art as a "transfer bunch" or "transfer tail." The transfer tail is segregated from the primary body of the yarn package so that an end of the yarn wound onto the core can be readily found at a later point in time. For example, the transfer tail can be subsequently tied to the yarn end of another yarn package to allow a series of yarn packages to be connected so that when the thread of the first package runs out during a manufacturing process, unwinding of the thread on the second package immediately begins.

One problem encountered during and after winding of the yarn onto the core, particularly when the yarn core is covered with a smooth exterior paper covering, is the slippage of the transfer bunch or tail off of, or along the core. Several prior techniques of securing the transfer tail to the core have been proposed. In one such technique, a narrow continuous groove or ring is formed circumferentially about one end of the exterior peripheral surface of the yarn core. The yarn is held in contact with the groove of a rotating yarn core until several yarn windings are retained therein to secure the transfer bunch.

In another technique, the circumferential exterior peripheral surface of the core is roughened by abrading or grinding the paper surface. This results in the surface filaments or fibers being raised from the body of the core and thus providing a continuous roughened area which will provide friction or retention of the yarn.

U.S. Pat. No. 2,569,094 to Dunlap discloses another textile core for supporting yarn packages against slippage on the core. The core is disclosed as having knob-like raised configurations or bosses spaced circumferentially at either end of the core. The spaced bosses provide a configured pattern at the ends of the core adapted to anchor the end loops against slippage. The spaced bosses may be formed on the core either by forming them in a semi-circular paper blank and applying the blank to the core after it is formed or by embossing the raised portions in the core body after it is formed. This structure has not, however, achieved widespread commercial acceptance.

These and other core configurations can provide some amount of anti-slip properties to the exterior of a core to prevent slippage of a transfer tail during and after winding processes. However, there can be problems associated with these configurations. For example, typically cores having a circumferential groove around one end thereof exhibit decreased core structural integrity. This is especially noticeable in the sidewalls of the core, which can exhibit reduced strength.

Similarly, processes used to form cores having a roughened or abraded surfaces can also result in a weakened sidewall structure. For example, the core must be maintained at a specific angle while in contact with the abrading surface. If the angle position is moved even slightly outside of the beginning plane, then the abrading device can cut into the surface of the cone, resulting in an uneven, weakened sidewall. In addition, it is often desirable to provide visible indicia on the surface of the core, designating, for example, the source or type of yarn. Printing such indicia is typically difficult to achieve on a roughened surface.

The past decade has evidenced continually increasing speeds for winding of yarns onto textile cores. As the winding speeds have increased, the need to form transfer tails at increasing winding speeds has resulted in increasing slippage of transfer tails either off of, or along the core, resulting in increasing numbers of defective yarn packages. However the increasing yarn winding speeds have also increased the need for yarn cores of high wall strength.

SUMMARY OF THE INVENTION

The present invention provides an improved textile core for winding a package of yarn. The textile core of the invention includes yarn engagement means for frictionally engaging a transfer tail of a yarn package, the formation of which does not decrease the strength of the core, and in particular the sidewalls thereof. Further, printed indicia may be easily applied to the surface of the textile core of the invention to provide readily accessible information regarding the product carried thereon. The yarn engagement means can be simply formed and provides an efficient and effective means for preventing slipping of the transfer bunch during and after winding.

In the present invention, the improved textile core for winding a package of yarn includes a tubular body having opposed ends and a bodywall formed of a paperboard material. The tubular body may be frustroconically or cylindrically shaped, and is formed of any of the known types of paperboard material using known techniques.

To prevent slipping of the transfer bunch during and after winding of the yarn to form the yarn package on the core, a yarn engagement means is provided to frictionally engage a transfer tail of the yarn package. The yarn engagement means of the invention is provided on the exterior periphery of the tubular body adjacent at least one end of the textile core and includes a plurality of spaced, discreet perforations, which extend substantially around the circumferential periphery of the tubular body, and which preferably are formed as a circumferentially aligned row of perforations. The core may have one row of perforations, or may include a plurality of circumferential arrays of perforations extending along substantially the entire longitudinal peripheral surface of the tubular body.

Each of the perforations extend radially into the bodywall of the textile core. The perforations, defined by an open top and a closed bottom, are shallow, extending into the bodywall for only a portion of the thickness thereof. Thus the presence of the perforations in the sidewall does not adversely effect or decrease the strength of the sidewalls.

Adjacent each of the perforations is a discreet projection extending radially outwardly of the bodywall of the core. The projections are fibrous in nature, being formed of paperboard material removed from the adjacent perforation. The projections are formed during the step of forming perforations in the bodywall of the core and thus a plurality of roughened contact points are provided along the exterior surface of the core without the need for adding extra material to the core body. The individual projections defined by the plurality of individual roughened areas provide a plurality of rough, raised surface projections for contacting and mechanically entangling yarn windings placed beside of, or onto the top of the projections. Yet because the roughened area is formed of a plurality of discrete projections, as opposed to a continuous circumferential groove or a continuous abraded area, the strength of the core sidewall is not adversely effected.

In one embodiment of the invention, the textile cores of the invention are formed using a simple and efficient process, and do not require expensive and specialized equipment. In this embodiment of the invention, the yarn engaging means is formed by bringing a portion of the exterior peripheral surface of a paperboard core into pressure contact with a toothed blade. The toothed blade is rotated at a low speed relative to the surface speed of the textile core so that no groove or continuous cut is formed in the surface of the core. Thus the speed of the blade is just sufficient to provide discrete perforations in and around the circumferential periphery of the core. As each tooth of the blade enters into and exits the surface of the core, it forms a discrete projection adjacent the just-formed perforation by pulling a segment of paperboard upwardly and out of the core. Preferably, the toothed blade is a circular blade having beveled teeth.

Improved textile cores according to the invention readily entangle with windings provided thereon and thus effectively prevent a transfer tail from slipping off of the core. Yet the yarn engagement means of the improved textile core provide mechanical frictional engagement of the yarn windings without a corresponding loss in the strength of the core sidewalls. Therefore, the textile cores of the invention can be effectively used in high speed processes during and after winding processes. The number of defective yarn packages resulting from transfer tail slippage is thus reduced, resulting in increased productivity and savings for both the manufacturer and user of the yarn package.

In addition, the textile cores of the invention are easily manufactured and do not require expensive and difficult core forming techniques. Thus, textile cores according to the invention can have improved transfer tail entanglement as compared to prior art cores yet can be more efficiently and easily prepared as compared to prior art core manufacturing processes.

BRIEF DESCRIPTION OF THE DRAWINGS

In the drawings which form a portion of the original disclosure of the invention:

FIG. 5 is a perspective view of one preferred process for forming a textile core in accordance with the present invention illustrating a textile core in contact with a rotating toothed blade;

FIG. 6 is an enlarged fragmentary cross-sectional view of the blade and textile core shown in FIG. 5 illustrating the contact between the toothed blade and the exterior peripheral surface of the core during formation of yarn engagement means of the present invention;

FIG. 7 is a greatly enlarged fragmentary view of FIG. 6 illustrating formation of the perforations and projections of yarn engagement means of the present invention; and FIG. 8 is a perspective view of another embodiment of the textile core of the present invention illustrating a plurality of yarn engagement means distributed substantially across the entire longitudinal periphery of the textile core.

DETAILED DESCRIPTION OF THE INVENTION

In the following, preferred embodiments of the invention are described in detail. It will be recognized that specific terms used in describing the invention are used in the descriptive sense only and not for purposes of limitation. Moreover, it will be apparent that the invention is susceptible to numerous alterations, variations and modifications within its scope.

Figure 1:
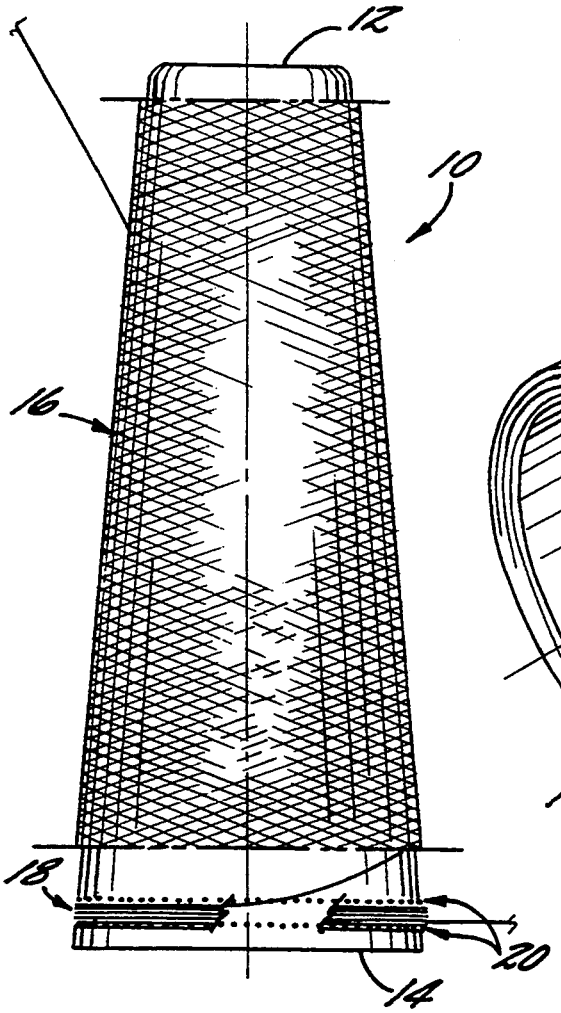
FIG. 1 is a perspective view of one preferred textile core of the invention having a yarn package and yarn engagement means positioned on the exterior periphery adjacent one end of the core.

FIG. 1 illustrates a perspective view of a textile core of the invention having a package of yarn thereon. The textile core includes a tubular body designated generally at 10 having opposed ends 12 and 14. The tubular body comprises a body wall 16 formed of a paperboard material. Although illustrated as having a frustroconical, i.e. conical shape, it will be apparent that the tubular body could also have a cylindrical shape, spool-like shape or other shape.

As illustrated in FIG. 1, body wall 16 is formed by a conventional convolute wrapping process known in the art. However, the body wall can also be formed by a spiral wrapping process. In preferred embodiments, body wall 16 will include multiple paperboard layers. Both the convolute wrapping process and the spiral wrapping process are well known to those skilled in the art. In general, such processes include the wrapping of one or more adhesive coated plies around a mandrel to provide a tubular body. The thickness of the body wall and the density of the paperboard ply used in the wrapping process are chosen to provide the desired strength in the resultant body wall. For example, where the core is intended for a light-duty or light-weight uses, the paperboard ply can have a light density and/or light weight and the body wall thickness can be relatively low, for example, in the range of from about 0.065 inches to about 0.090 inches. For heavy-duty uses, a thicker body wall, for example, in the range of between about 0.090 inches and about 0.150 inches is needed and typically a heavy and/or thick paperboard ply material is used.

FIG. 1 also illustrates a transfer bunch or transfer tail of the yarn package, designated generally at 18. As shown in FIG. 1, transfer tail 18 of the yarn package is circumferentially positioned around the exterior periphery of tubular body 10 adjacent one end 14 thereof.

In addition, FIG. 1 illustrates yarn engagement means of the invention, designated generally at 20, also circumferentially provided around the exterior periphery of tubular body 10 adjacent end 14. As seen in FIG. 1, yarn engaging means has the appearance of a plurality of circular-shaped areas linearly aligned in two spaced-apart rows and circumferentially extending around the exterior periphery of tubular body 10.

Yarn engagement means 20 is provided to mechanically entangle and hold the transfer tail yarn windings at a location spaced from the main yarn package which is built onto the yarn core. As known in the art, the transfer tail can be tied or otherwise joined to the yarn end from another yarn package as previously described.

Figure 2:
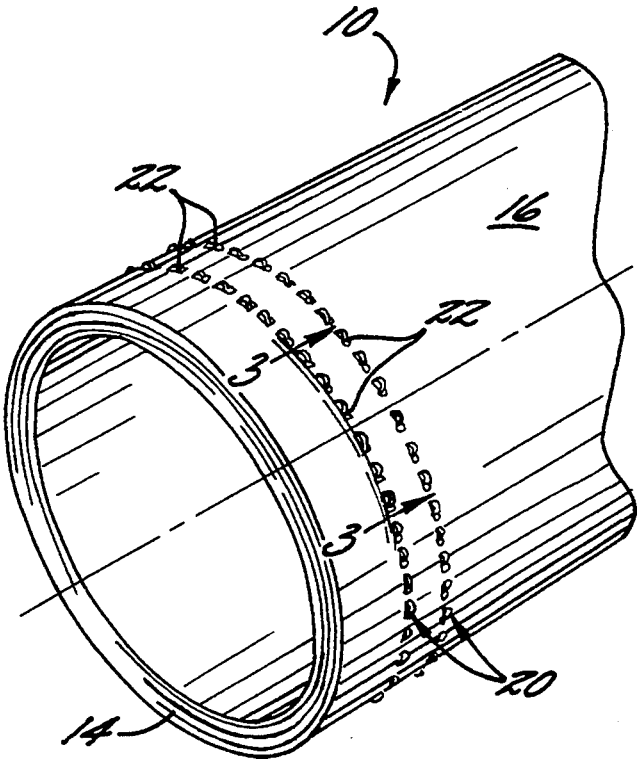
FIG. 2 is an enlarged fragmentary perspective view of one end of the textile core of FIG. 1 illustrating an enlarged view of yarn engagement means of the invention.

FIG. 2 is an enlarged fragmentary perspective view of one end of the textile core of FIG. 1 illustrating an enlarged view of yarn engagement means 20 of the invention. Yarn engagement means 20 for engaging yarn windings includes a plurality of spaced, discrete perforations 22.

Perforations 22 extend substantially around the circumferential periphery of tubular body 10. As used herein, the term "substantially around the circumferential periphery" refers to the presence of a plurality of spaced, discrete perforations extending around greater than at least half of the circumferential periphery of tubular body 10. Preferably the perforations extend around more than about 60 percent, more preferably around more than about 75 percent, and most preferably extend around more than about 90 percent of the circumferential periphery of the tubular body.

As illustrated in FIG. 1 and FIG. 2, the plurality of discrete spaced-apart perforations are linearly aligned and extend circumferentially in two spaced-apart rows around the exterior periphery of the tubular body 10. As explained in more detail below, yarn engagement means 20 can include other arrangements of perforations 22, such as a spiral arrangement thereof, although preferably the perforations are in a substantially linear alignment. The yarn engaging means can include one such linear array, two arrays as illustrated, or more, and can be formed as plurality of circumferential arrays of perforations extending substantially across the entire longitudinal peripheral surface of tubular body 10. A core having a plurality of circumferential arrays is illustrated in FIG. 8.

Figure 3:
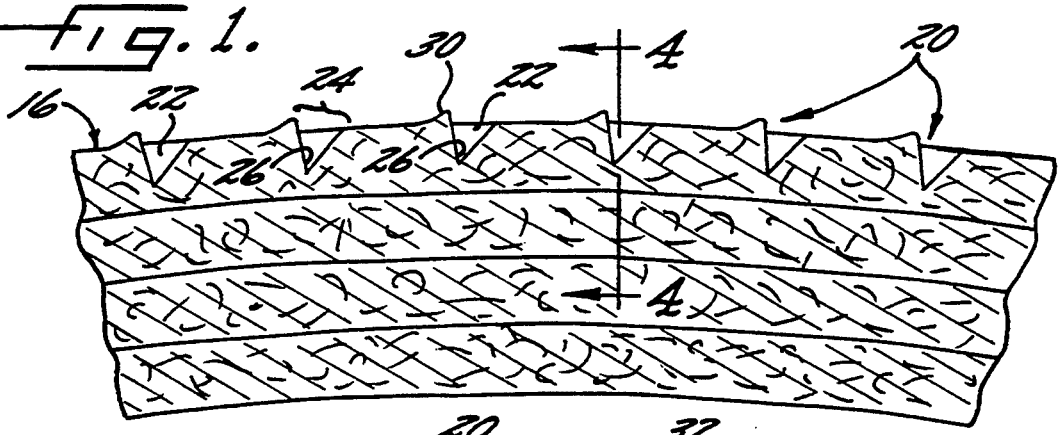
FIG. 3 is an greatly enlarged cross-sectional view of the textile core of FIG. 2 taken along line 3—3 illustrating the perforations and adjacent projections of the yarn engaging means of the invention.

FIG. 3 is a greatly enlarged cross-sectional view of the textile core of FIG. 2 taken along line 3—3, illustrating perforations 22 of yarn engaging means 20 of the invention. As best seen in FIG. 3, each of spaced, discrete perforations 22 extend radially into bodywall 16. Perforations 22 extend radially into bodywall 16 for only a portion of the thickness thereof, preferably to a depth of from about 0.028 to about 0.030. This is advantageous in that the structural integrity, and thus the sidewall strength, of the tubular body is not diminished. Thus, the textile core of the invention can better withstand the stresses involved in winding and subsequent processes than prior textile core configurations. Each of spaced, discrete perforations 22 are further defined by an open top 24 and a closed bottom 26.

Each spaced, discrete perforation 22 is adjacent a projection 30 which extends radially outwardly from the peripheral surface of bodywall 16. Projections 30 are fibrous in nature, comprising paperboard material which is removed from each adjacent perforation 22 during formation thereof. Outwardly extending projections 30 act to roughen the surface of body wall 10 along a plurality of discrete locations so that a transfer tail, instead of being placed against a relatively smooth outer covering over which it can slide, will be frictionally engaged and held. Because the transfer tail is frictionally engaged by projections 30, the depression of each of perforations 22 can be shallow; there is no need for the transfer tail to be engaged within a continuous groove or engaged within the perforations.

Perforations 22 and projections 30 are provided in number sufficient to engage yarn windings and prevent slippage thereof. Preferably, bodywall 16 comprises about 10 to 30 perforations per inch, and more preferably about 15 to 25 perforations per inch, around the circumferential periphery of tubular body 10.

Figure 4:
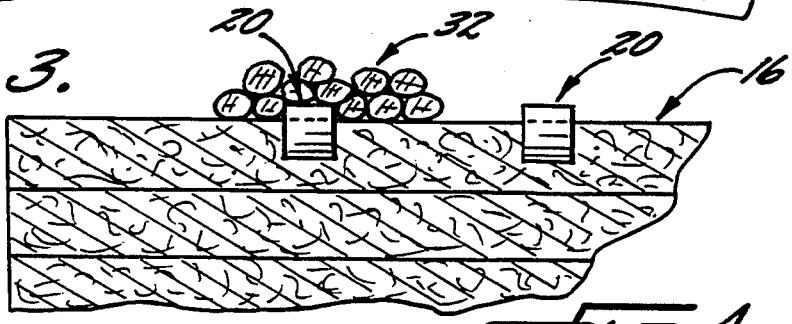
FIG. 4 is a cross-sectional view of yarn engagement means of FIG. 3 taken along line 4—4 and illustrating a plurality of yarn windings formed on the top thereof.

FIG. 4 is a cross-sectional view of yarn engagement means 20 of FIG. 3 taken along line 4—4 and illustrating a plurality of yarn windings 32 formed on the top thereof. As will be seen the projections frictionally engage one or more of the windings to thereby anchor the winding or windings on the surface of the core. Windings formed on top of the 'anchored' winding or windings are frictionally engaged with the underlying winding(s) and are thereby also anchored in place. FIG. 4 further illustrates that each of perforations 22 extend radially into body wall 10 for only a portion of the thickness thereof. Although perforations 22 appear in FIG. 4 as having a substantially square shape, it will be appreciated by the skilled artisan that perforations 22 may have other configurations, for example, have at least one angled sidewall.

FIG. 5 is a perspective view of one preferred process for forming a textile core in accordance with the present invention and illustrates a textile core in contact with a rotating toothed blade 40. To form the textile core of the present invention, toothed blade 40 is provided and brought into pressure contact with a portion of the exterior peripheral surface of a tubular body 10 of a paperboard core. Toothed blade 40 is rotating at a low speed which is insufficient to form a continuous cut in the surface of the core but which is sufficient to provide a plurality of spaced, discrete perforations 22 as described above extending substantially around the circumferential periphery of the core, each of the perforations extending radially into the body wall for only a portion of the thickness thereof. As toothed blade 40 comes into pressure contact with a portion of the peripheral surface of the core, paperboard material which is removed by the toothed blade to form perforations 22 is lifted so that paperboard projections 30 extends radially outwardly of the core body wall adjacent each perforation.

FIG. 5 illustrates one preferred construction of toothed blade 40. Toothed blade 40 includes a substantially planar blade body 42 having two opposed sides and including a peripheral toothed cutting edge 44. Advantageously, toothed blade 40 has a predetermined body width between opposing sides of about 0.120 to 0.125 inches. As illustrated, cutting edge 44 is beveled on side of the blade body 42. The angle of the bevel is preferably an acute angles as defined by the angle formed between the plane 46 of the blade body and the plane defined by the cutting edge 44 of the blade as generally indicated by arrows 48. Advantageously, this acute angle is from about 25° to 30° to plane 46 of blade body 42. Preferably the blade has between about 17 and about 18 teeth per inch, each having a radial height of between about 0.025 and about 0.035 inch.

In a preferred embodiment, at least two toothed blades are provided to form two spaced-apart linearly arranged rows of perforations. It will be apparent, however, to the skilled artisan that one toothed blade up to a number of toothed blades sufficient to provide the desired arrangement of arrays of perforations extending longitudinally substantially across the entire exterior peripheral surface of the core may be used.

Blade 40 is used to form the plurality of spaced, discrete perforations 22 in tubular body 10 using a conventional apparatus as generally illustrated in FIG. 5. As illustrated in FIG. 5, two toothed blades are attached to a rotating means 50 of a conventional type and brought into pressure contact with tubular body 10 which is also rotated by means 52. Toothed blades 40 are pressed into tubular body 10 during rotation of both the blades and the tubular body to thereby form a plurality of spaced, discrete perforations 22.

Toothed blade 40 is rotated at a speed sufficient to provide a plurality of spaced, discrete perforations as described above. As will also be appreciated by the skilled artisan, the speed of rotation of toothed blade 40 will vary depending upon the construction of the textile core of the invention, and the desired degree of perforation in the tubular body and the rotational speed of the core. In a preferred embodiment, toothed blade 40 is rotated at a speed about the same as the speed of the core.

FIG. 6 is a fragmentary enlarged cross-sectional view of a portion of FIG. 5, illustrating the direction or rotation of one of toothed blades 40 and tubular body 10. FIG. 6 also illustrates the contact between the toothed blade and the exterior peripheral surface of the core during formation of yarn engagement means 20 of the present invention. Although FIG. 6 illustrates rotation of tubular body 10 in a counter-clockwise direction and rotation of blade 40 in a clockwise direction, it will be apparent that these directions can be reversed. It will also be apparent that although toothed blade 40 is illustrated as a circular cutting blade, blades having a straight surface and blades having an arcuate cutting surface which extends less than a full 360° can also be provided.

FIG. 7 is a fragmentary greatly enlarged view of one of toothed blades 40 and the exterior peripheral surface of tubular body 10 of FIG. 6. FIG. 7 illustrates in greater detail the formation of the plurality of perforations 22 of yarn engagement means 20 of the present invention. FIG. 7 illustrates that as blade 40 and tubular body 10 are rotated, teeth edge 44 of blade 40 punctures the exterior peripheral surface of tubular body 10 to form perforations 22 and raises fibers of the paperboard material to provide a projection 30 extending radially outwardly from the exterior surface of the tubular body 10. As described above, these upwardly extending projections 30 in the transfer tail area catch yarn or thread being wound onto the core and hold it in place.

In use, the textile core of the invention is placed on an appropriate winder and rotated. Following initiation of the windup process, a transfer tail is formed either manually by an operator or by means of an automatically acting apparatus which maintains the threadline over the yarn engagement means for a suitable number of turns, e.g., 10–20 turns.

Textile cores in accordance with the present invention can have significant advantages and benefits. Because the yarn engagement means is formed of a plurality of discrete spaced perforations, good anti-slip properties are provided on the peripheral surface of the core body without a concomitant adverse affect on the structural integrity, and thus the strength, of the core. Thus textiles cores formed according to the present invention can be effectively used both during winding processes and in subsequent applications at high speeds without slippage of the transfer tail occurring. In addition, the textiles cores of the invention are simply made, and do not require complicated surface treatment techniques.

The invention has been described in considerable detail with reference to its preferred embodiments. It will be apparent, however, that numerous variations and modifications can be made without departure from the spirit and scope of the invention as described in the foregoing detailed specification and defined in the appended claims.

That which is claimed is:

1. A textile core for winding a package of yarn comprising:

a tubular body having opposed ends comprising a bodywall formed of a paperboard material; and a yarn engagement means for frictionally engaging a transfer tail positioned on the exterior periphery of said tubular body adjacent at least one end thereof comprising a plurality of spaced, discrete perforations extending substantially around the circumferential periphery of said tubular body, each of said perforations extending radially into said bodywall for only a portion of the thickness thereof and being defined by an open top and a closed bottom and each of said perforations being adjacent a projection extending radially outwardly of said bodywall comprising paperboard material removed from said adjacent perforation, said projections being capable of frictionally engaging a segregated grouping of yarn windings and holding the segregated grouping of yarn windings as a transfer tail bunch at a location spaced apart from the package of yarn and adjacent one end of said tubular body, and wherein a portion of said tubular body is adapted to support the package of yarn and has substantially different frictional characteristics than said yarn engagement means.

2. A textile core according to claim 1 wherein said plurality of discrete, spaced perforations extend around more than 60% of the circumferential periphery of said tubular body

3. A textile core according to claim 1 wherein said plurality of discrete, spaced perforations extend around more than 75% of the circumferential periphery of said tubular body.

4. A textile core according to claim 1 wherein said plurality of discrete, spaced perforations extend around more than 90% of the circumferential periphery of said tubular body.

5. A textile core according to claim 1 wherein said perforations comprise a substantially linearly aligned array extending around the circumference of said tubular body.

6. A textile core according to claim 5 wherein said perforations comprise a plurality of said linearly aligned arrays of perforations.

7. A textile core according to claim 1 wherein said perforations comprise about 10 to about 30 perforations per inch around the circumferential periphery of said tubular body.

8. A textile core according to claim 1 wherein said perforations comprise about 15 to about 25 perforations per inch around the circumferential periphery of said tubular body.

9. A textile core according to claim 1 wherein said perforations extend radially into said bodywall about 0.020 to about 0.025 inches.

* * * * *